US008017919B2

(12) United States Patent
Sewell et al.

(10) Patent No.: US 8,017,919 B2
(45) Date of Patent: Sep. 13, 2011

(54) MULTI-ELECTRODE NEGATIVE ION GENERATOR

(75) Inventors: Peter B. Sewell, Sterling, VA (US); Richard J. Luscombe-Mills, Sterling, VA (US)

(73) Assignee: Newaire, Inc., Sterling, VA (US)

( * ) Notice: Subject to any disclaimer, the term of this patent is extended or adjusted under 35 U.S.C. 154(b) by 296 days.

(21) Appl. No.: 12/344,033

(22) Filed: Dec. 24, 2008

(65) Prior Publication Data

US 2009/0206274 A1 Aug. 20, 2009

Related U.S. Application Data

(60) Provisional application No. 61/017,291, filed on Dec. 28, 2007.

(51) Int. Cl.
*H01J 27/00* (2006.01)

(52) U.S. Cl. ..... 250/423 R; 250/423 F; 250/424

(58) Field of Classification Search ..... 250/423 R
See application file for complete search history.

(56) References Cited

U.S. PATENT DOCUMENTS

| | | | | |
|---|---|---|---|---|
| 3,582,645 | A * | 6/1971 | Brunnee et al. | 250/423 F |
| 5,316,741 | A * | 5/1994 | Sewell et al. | 422/186.21 |
| 6,686,592 | B1 * | 2/2004 | Sakairi et al. | 250/324 |
| 6,825,464 | B2 * | 11/2004 | De La Mora | 250/288 |
| 2003/0122085 | A1 * | 7/2003 | Stengl et al. | 250/423 F |
| 2004/0245457 | A1 * | 12/2004 | Granger et al. | 250/288 |

* cited by examiner

*Primary Examiner* — Phillip A Johnston

(74) *Attorney, Agent, or Firm* — Birch, Stewart, Kolasch & Birch, LLP

(57) ABSTRACT

A negative ion generator includes a multi-electrode device with an emitter for generating a current. A first counter electrode includes an aperture therein with a distal end of said emitter being operatively positioned within said first counter electrode. A second cylindrical electrode includes an aperture therein with the second counter electrode being spaced a predetermined distance from the first counter electrode and being operatively positioned relative to the emitter for increasing the through-put of the negative ion generator by reducing the total emitted current while maintaining a fairly constant level of available negative ion current.

5 Claims, 9 Drawing Sheets

MULTI-ELECTRODE NEGATIVE ION GENERATOR

This Nonprovisional application claims priority under 35 U.S.C. §119(e) on U.S. Provisional Application No. 61/017,291 filed on Dec. 28, 2007, the entire contents of which are hereby incorporated by reference.

BACKGROUND OF THE INVENTION

1. Field of the Invention

The present invention is directed to a multi-electrode negative ion generator which in addition to the ion emitting electrode may include one or two additional electrodes with voltages being supplied by the generator to control the negative ion emission.

2. Description of Background Art

With regard to the use of a negative ion generator (NIG) if the cabinet for housing the NIG is a grounded metal cabinet, then all the ion current from the emitter is collected on the metal cabinet and little, if any passes through the openings of the screen.

As a result most ion generators developed for domestic use, which are generally in insulating cabinets, produce a very low output of negative ions. To produce any significant ion current output, the pointed high voltage electrode is placed very close to the aperture of an insulating screen. In some instances, this high voltage tip can be contacted easily with fingers through the screen.

If a NIG is housed in a plastic cabinet and the ion source is placed at a short distance behind the plastic screen, then negative charge accumulating on the screen will ultimately develop a potential equal to that on the discharge source. When this occurs, the ion emission from the unit drops to negligible value. For example, when a free standing point emitting about 1000 nanoamps (1 microamp or 1 millionth of an ampere) of ion current is placed within a plastic cabinet, the ion emission detected outside the cabinet quickly drops by a factor of 1000 to less that 1 nA. This is particularly so when the location of the ion emitter is sufficiently remote from the cabinet screen (about 10 mm) to satisfy UL requirements.

SUMMARY AND OBJECTS OF THE INVENTION

According to an embodiment of the present invention, a duel or a triode potential negative ion generator is provided wherein the negative ion generator (NIG) is centered around field emission from a sharp point held at a high negative potential, typically about 4 to 14 kV. A highly enhanced electric field created by the small radius of curvature of the point or points, generates a local field in excess of about 10 million volts/cm, even though the applied potential is only some 10 kilovolts. This high field causes electrons to be emitted from the tip at room temperature and these are accelerated away from the tip. The electrons interact with the atmospheric gases and produce mainly positively and negatively charged ions of oxygen, nitrogen and water vapor. Most of the positively charged ions are attracted back to the negative tip, while the negative ions and free electrons are strongly repelled in the electric field and travel large distances away for the source.

These and other objects of the present invention are achieved by providing a negative ion generator that includes a diode device with an emitter for generating a current. A first counter electrode includes an aperture therein with a distal end of said emitter being operatively positioned within said first counter electrode. A second counter electrode includes an aperture therein with the second counter electrode being spaced a predetermined distance from the first counter electrode and being operatively positioned relative to the emitter for increasing the through-put of the negative ion generator by reducing the total emitted current while maintaining a fairly constant level of available negative ion current.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5(*b*) is a circuit for a two stage multiplier;

DETAILED DESCRIPTION OF THE PREFERRED EMBODIMENTS

The basic concept of the NIG according to an embodiment of the present invention is centered around field emission from a sharp point held at a high negative potential, typically about 4 to 14 kV. The highly enhanced electric field created by the small radius of curvature of the point or points, generates a local field in excess of about 10 million volts/cm, even though the applied potential is only some 10 kilovolts. This high field causes electrons to be emitted from the tip at room temperature and these are accelerated away from the tip. The electrons interact with the atmospheric gases and produce mainly positively and negatively charged ions of oxygen, nitrogen and water vapor. Most of the positively charged ions are attracted back to the negative tip, while the negative ions and free electrons are strongly repelled in the electric field and travel large distances away for the source.

Figure 1:
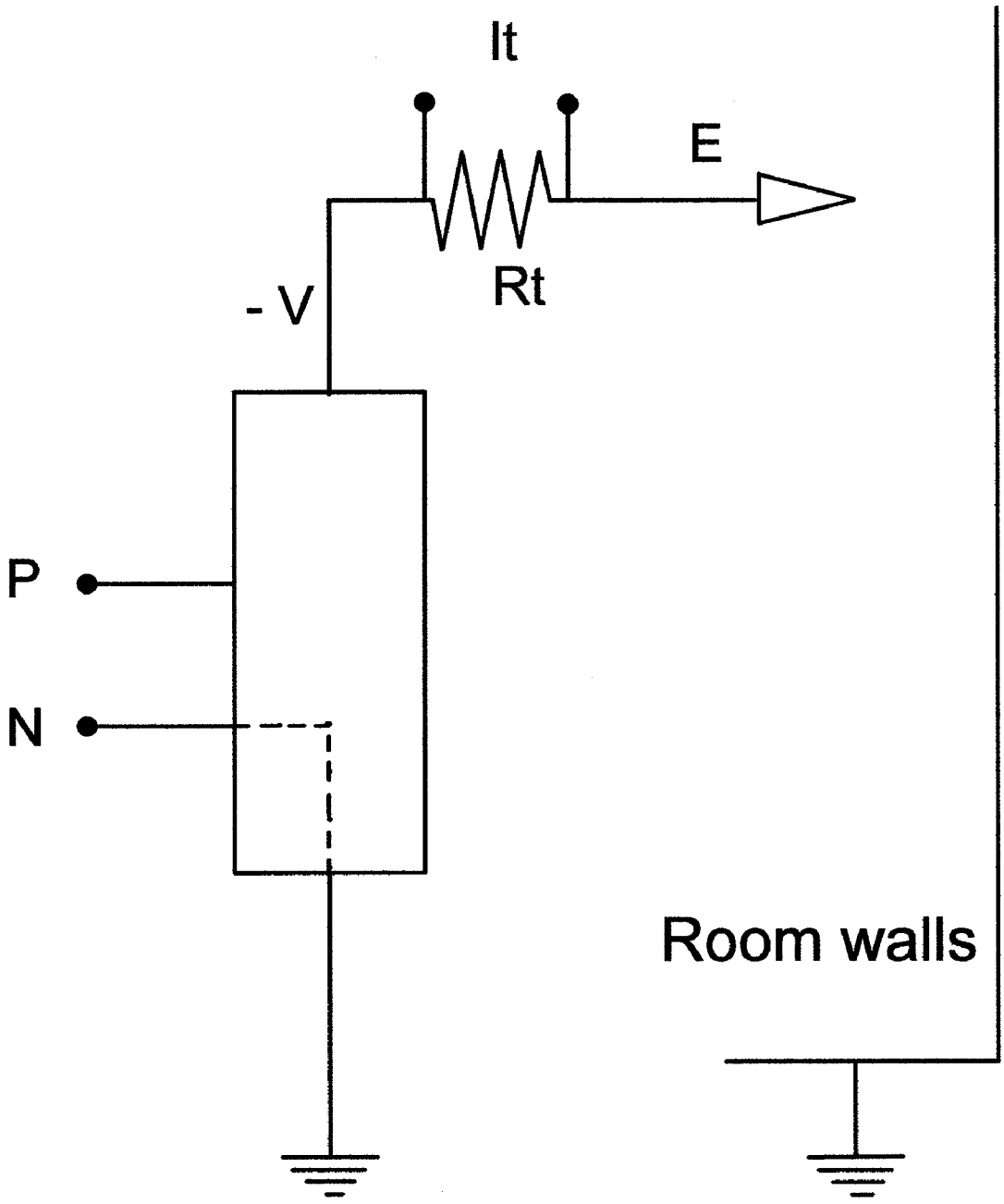
FIG. 1 is a basic circuit of a negative ion generator.

As illustrated in FIG. 1, an where E is the emitter E held at a high negative potential V and the emitted current ($i_t$) is measured by the voltage drop across the resistance $R_e$. The room walls act as the ground return for the circuit. Thus, to create a free standing NIG is not a difficult task. However, when the generator has to be housed in a protective cabinet to protect the user from unwanted high voltage shocks and to comply with UL regulations, the problem becomes more complicated. Two major problems are outlined briefly.

According to an embodiment of the present invention, negative ion generation is provided which results in a large percentage of the total ion emission passing through the screen of a cabinet based on a dual potential negative ion source.

Figure 2:
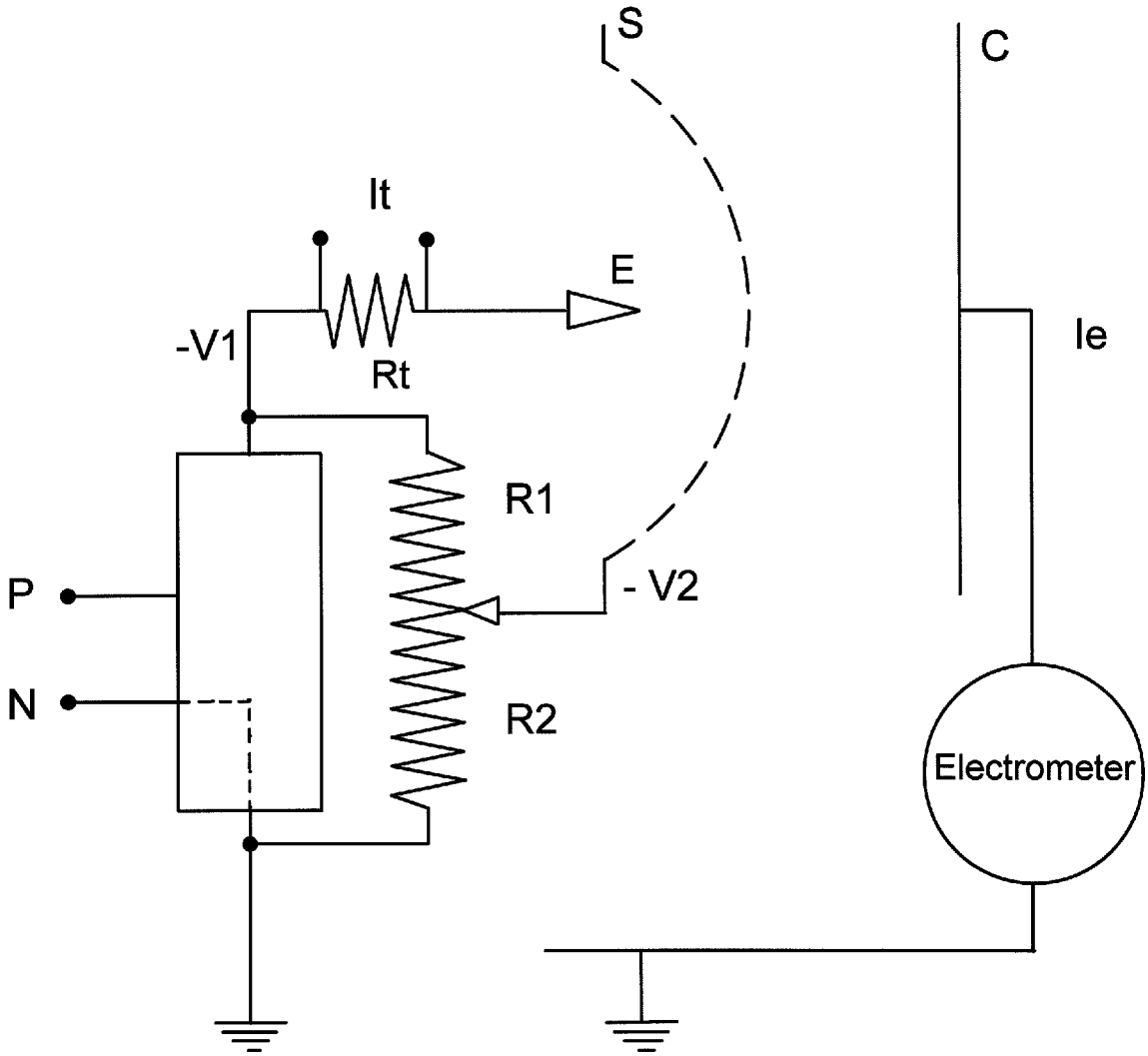
FIG. 2 is circuit for a negative ion generator with a variable resistor.
Figure 3:
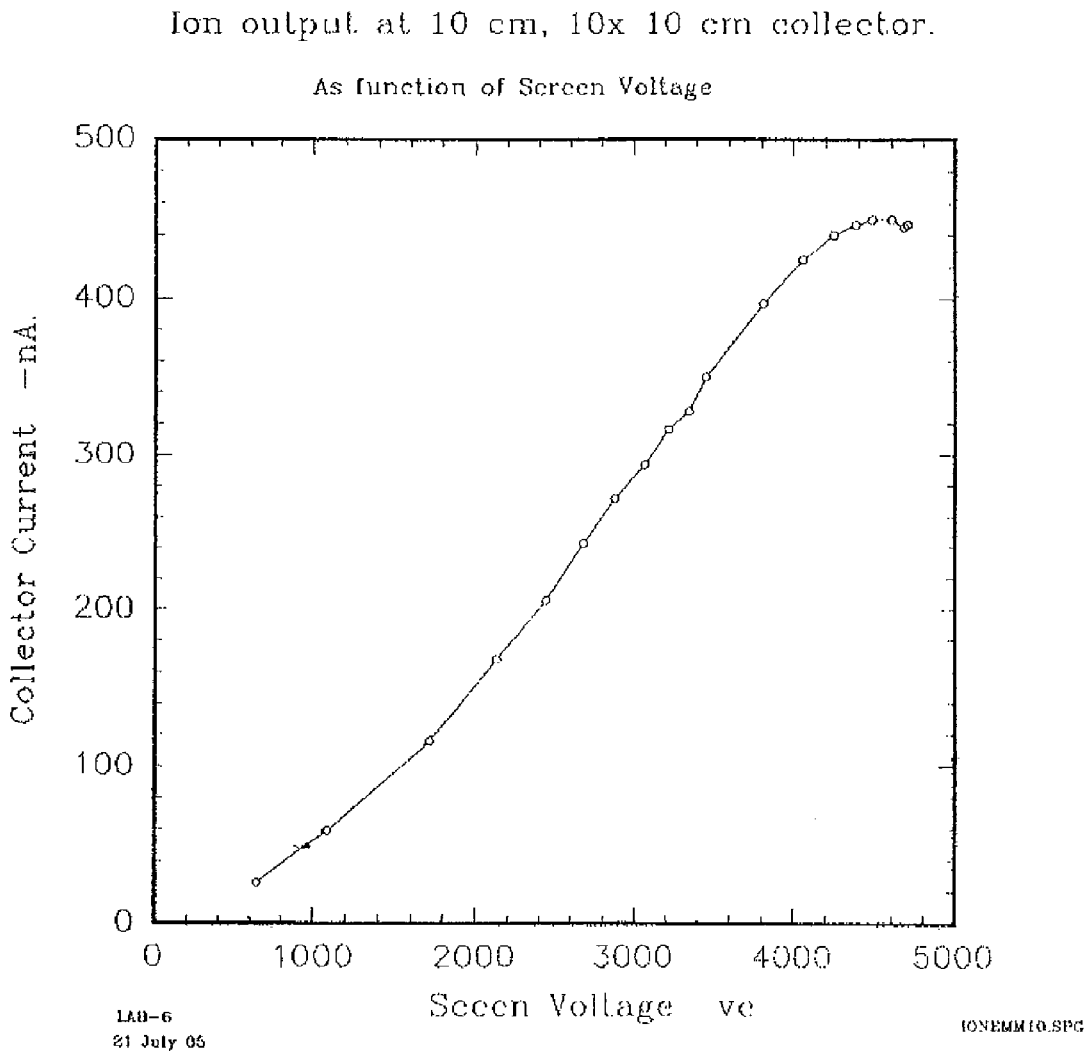
FIG. 3 is graph illustrating the relationship between rising voltage as compared to collected ion current.

As illustrated in FIG. 2, the point source (E) that is at a negative potential V1, emits towards a conductive screen with about 50% transparency (that is, the hole area as a percentage of the total area of the screen). In one form, the screen is a conductive film on the insulating cabinet screen and this is held at a second potential V2. When negative ion emission through the screen ($i_e$) is measured at a point remote from the screen, this current varies as shown in FIG. 3. These results were obtained with V1 at 8.5 kV and a 100 $cm^2$ ion collector located at 10 cm for the screen and by varying the screen voltage V2.

As the potential V2 on the screen rises from zero (as would be the case for a grounded screen), the collected ion current increases steadily to a maximum value at a potential of about 4.4 to 4.8 kV (4400-4800V) and then begins to fall. This fall continues as the voltage rises further and when the voltage finally reaches V1 (not shown in FIG. 3), then little or no ion current is measured. This is equivalent to the case when the screen is completely insulating, as described earlier.

With this dual potential arrangement, the total output of the system with a fixed emitter voltage V1, can be controlled by the value of the screen potential V2. For maximum output of the system, the potential V2 is approximately 50% of the emitter potential V1. This behavior is partly due to an electrostatic focusing effect of the screen voltage V2.

The presence of a high voltage V2 at the screen might appear to be a safety hazard, however this is not necessarily the case. There are various methods of delivering the voltage V2 to the screen and all result in a very high impedance between the screen and the power supply and thus between any user and ground. High voltage contact is not noticeable due to the low capacity of the system and the extremely small currents that are possible between the user and ground.

There are various methods of applying the second potential V2 to the screen and two of these are described briefly.

Figure 4:
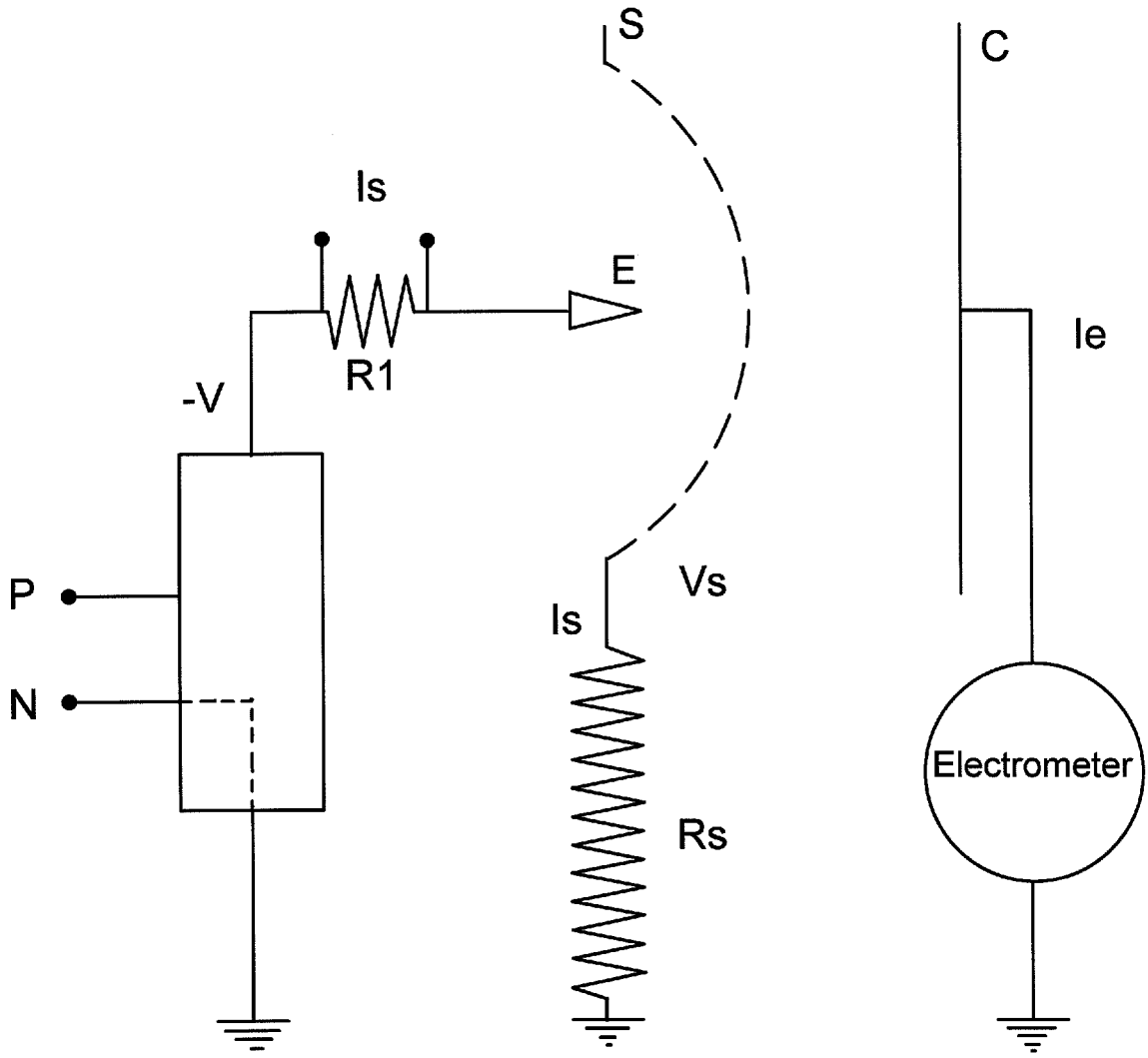
FIG. 4 is a circuit for a bleeder resistance method.

Bleeder Resistance Method, as illustrated in FIG. 4. Here, the conductive screen S is connected to ground through a high value resistance Rs whose value is typically in the range of 500 Megohm to 2000 Megohm. Negative ion current flowing to the screen and then to ground through the resistance produces a negative voltage V2 at the screen which is equal to the product of the leakage ion current $i_s$ and the resistance $R_s$.

A total ion emission $i_t$ flows from the tip at potential V1 and can be measured by the voltage drop across a resistance $R_1$ in the high voltage circuit. Part of this current ($i_s$) is intercepted by the screen and flows through the screen resistance $R_s$ to develop the screen voltage.

$$V_s = i_s \times R_s.$$

The voltage $V_s$ and hence the emitted ion current ($i_e$) is determined by the value of the resistance $R_s$ and the percentage of the total ion emission intercepted by the screen.

Applied Potential Method, as illustrated in FIG. 2. An alternative method of applying a potential V2 to the screen is to derive a potential from the power supply that drives the ion emitter at the full voltage V1. This is shown in principal in FIG. 2. Here the voltage V2 is derived from a bleeder resistance coupled between the high voltage V1 and earth, and V2 will depend on the ratio of the resistors R1 and R2 shown in FIG. 2.

Clearly, if R1=R2, the voltage V2 will be 50% (2) of V1. Since this is the voltage for maximum throughput for emitted negative ion current, this would be the value to select if the maximum negative ion output was required from the generator.

However if a reduced emission is required from this same device, then the ratio of R1 and R2 can be adjusted to produce a higher or lower voltage V2 on the screen and thus an emission at a reduced percentage of the maximum.

Figure 5A:
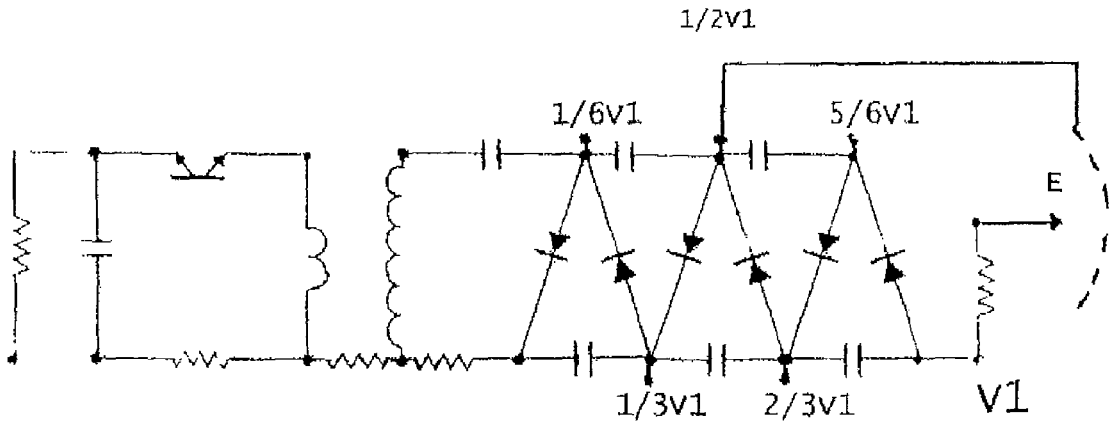
FIG. 5(*a*) is a circuit for six stage voltage multiplier.
Figure 5B:
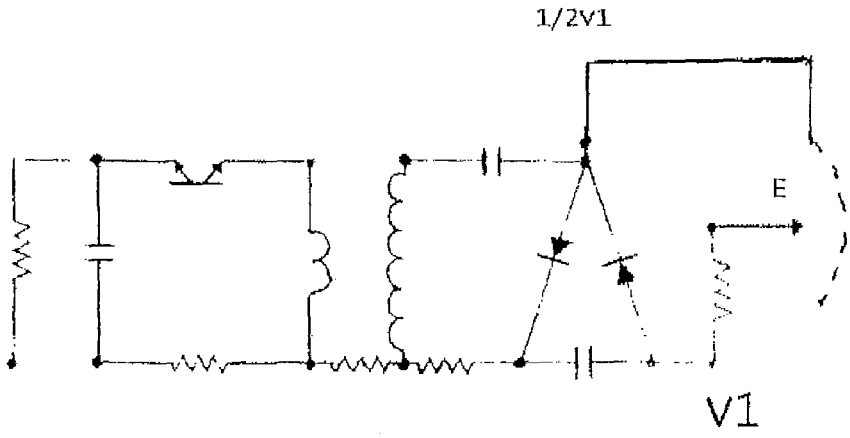

In practice, to avoid the expense of using a high value bleeder resistance, it is possible to select a potential from various levels of the voltage multiplier stack of the type generally used to produce the full potential V1. As shown in FIG. 5(*a*) for a six (6) stage voltage multiplier, of the type used in an embodiment of an ozone unit or Negative Ion Generator and FIG. 5(*b*) for a two (2) stage multiplier that may be incorporated in a low voltage NIG.

With the six stage multiplier various screen voltages can be selected at ⅙, ⅔, ⅙(½), ⅔(⅔), and ⅚ of the maximum potential V1. This allows for controlling the output to suit different applications, using the same basic system.

However for maximum output where a screen voltage of two (2) V1 is required, the two (2) stage multiplier circuit is ideal.

Various parameters that control the detail operation of the Negative Ion Generate include:

The detailed nature of the control screen, including:

The overall screen shape, be it concave, convex, flat or otherwise.

The shape and thickness of the holes in the screen.

The number of holes in the screen and the total transparency of the screen.

The nature and location of the ion emitter.

The material of the ion emitter.

The profile of the point on the ion emitter.

The separation of the tip of the ion emitter from the center of the screen.

The absolute value of the full potential V1.

The details of the earthing of the high voltage power supply and its influence on the maximum negative ion output possible for the system.

With regard to the bleeder resistance approach and the dual potential approach, the most consistent results have come from the dual potential approach, and that this is also the most effective and economically way to produce a negative ion generator.

Two generators of this type, based on the High Voltage Power Supply Inc. Model CS2 132L120-8 module have been fabricated using a cabinet with the Plastic Screen made conductive with Colloidal Graphite.

The emitter, a 0.060" diameter titanium rod, with a knife edge produced by wire cutters, located 10.6 mm behind the inner surface of the screen and operating at a potential of V1=8.85 kV and V2=4.55 kV.

Typical negative ion current collected on a 100 $cm^2$ detector located at 10 cm from the screen is 120 nA and at 1 cm from the screen ~500 nA, with a total ion emission from the tip at 1200 nA or 1.2 μA.

This represents about a 42% efficiency, and this is in the presence of an external ion detector, which monitors a small percentage of the total emission and thus reduces the measured free negative ion output.

With a total emission of about 1.2 μA, the ozone emission from this unit has been shown to be less than 1 mg/hr, and as a result, will have little effect on the general background level.

With respect to an embodiment of the present invention a Negative Ion Generator may be constructed for producing about 500 nA of total negative ion emission or about 3000 billion negative ions per second. This is greater than many prior small negative ion generators which generally produce a total negative ion output of 2000 billion per second or some 320 nA.

Figure 6:
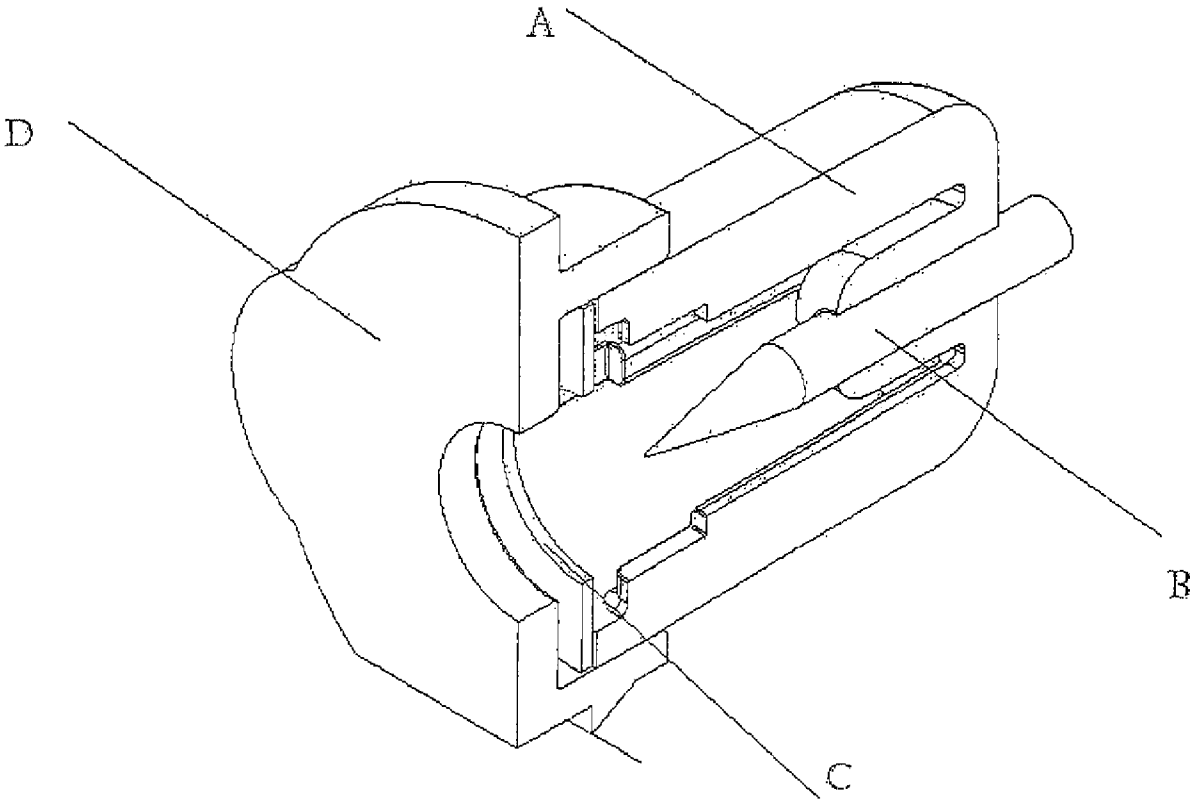
FIG. 6 is a schematic view of a diode negative ion generator.

As illustrated in FIG. 6, two active electrical elements of a miniature, single aperture device (A) include the emitter (B) and the counter electrode (C). An insulating cup (D) is provided as an insulating body for the device (A). From this point of view, the device might be called a two electrode, or diode type emitter, with emitter (B) being the first electrode, and counter electrode (C) being the second electrode. In this arrangement the total current from the emitter (B), as measured from the high voltage power supply, is a value $i_t$, generally measured in microamperes (μA). Because of the close proximity of the emitter (B) to the counter electrode (C), most of this current is delivered to the counter electrode (C), but a small percentage passes through the aperture in the counter electrode (C) and is available as negative ions for the treatment of the surrounding space. This current ($i_r$) is a small fraction of the total current ($i_t$), generally being in the range of fractions of a microampere and often quoted in nanoamperes (nA), were 1 μA equals 1000 nA. The ratio ($i_r/i_t$) can be referred to as the through-put or efficiency of the device.

For a miniature diode type negative ion generator, this efficiency is quite small at the level of about 2% and depends on the diameter of the aperture in the counter electrode (C) and the set-back of the tip of the emitter from this aperture. Hence for a total current $i_t$ of 25 μA the available ion current is only about 500 nA (~0.5 μA). While this is a very satisfactory level of negative ion emission, the high internal current within the generator gives rise to several deleterious effects including, (1) enhanced ablation and corrosion of the emitter tip, (2) enhanced oxidation of the aperture region of the counter electrode (C), and (3) ozone production which is generally proportional to the total emission current.

Figure 7:
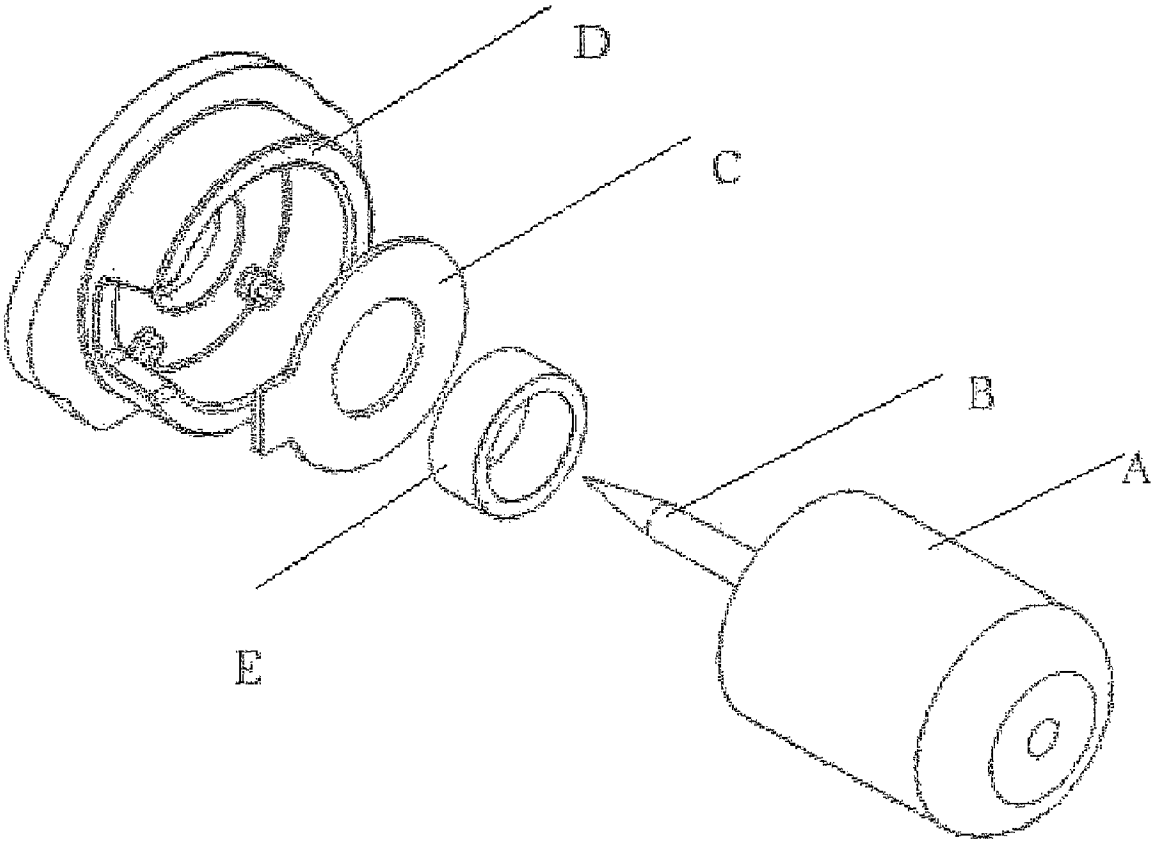
FIG. 7 is a schematic view of a triode negative ion generator.

As illustrated in FIG. 7, by adding a third electrode (E) to the dual voltage generator, it has been found possible to increase the efficiency or through-put to values as high as 50%. This three electrode miniature negative ion generator or triode generator is described as follows.

With regard to the performance of the miniature diode type negative ion generator, the effects of adding a third electrode (E) with the aim of improving the through-put of the device have been explored. The basic form of the additional electrode (E) in shown in FIGS. 7 and 8, where in addition to the basic elements of the diode device (A, B, C, D), an additional metal electrode (E) is located symmetrically around the emitter (B).

The effect of the third electrode (E) is to increase the through-put of the device by reducing the total emitted current ($i_t$) while maintaining a fairly constant level of the available negative ion current ($i_r$). The factors which influence the degree of improvement of through-put are (1) the inner diameter of the third electrode (E), (2) the length of the third electrode (E), and (3) the set-back of third electrode E from the counter electrode (C). This set-back is referred to as 'h' and in general, the smaller the value of 'h' for a particular electrode diameter, the higher is the through-put of the system. There is a practical limit to a reduction of the value of 'h' which is determined by electrical stability, as the third electrode (E) operates at a potential which is several kilovolts different from that of the counter electrode (C).

The inner diameter of the third electrode (E) is approximately the same as that of the diameter of the aperture in the counter electrode (C). For a typical miniature ion generator operating at about 8 kilo-volts, this aperture diameter is about 5 mm and the set-back is in the range of 1 to 2 mm when the emitter (B) set-back from the counter electrode (C) is 2.5 mm. Under such circumstances it is possible to achieve through-puts of 20% and higher.

The third electrode or control electrode (E) operates effectively with or without electrical connection to the high voltage power supply. In the isolated mode, the third electrode (E) develops an operating potential by intercepting negative ions from the emitter when the unit is first turned on. As the operating potential develops, the third electrode (E) repels negative ions and ultimately establishes and equilibrium potential. Due to the small capacity of the third electrode (<1 pF) the charging is almost instantaneous. Alternatively, the control electrode (E) can be connected to a potential divider on the main high voltage power supply via a conductor. When this is done it is found that an effective operating voltage on the third or control electrode (E) is between 60 and 70% of the potential on the emitter (B). It is assumed that a similar potential is automatically developed on the third electrode (E) when operating in the isolated mode.

The advantage of having an isolated third or control electrode (E) is that no additional electrical connections are required for the operation of the unit. This is a particular advantage when the unit is designed for use as a plug-in or 'cartridge' device.

Figure 8:
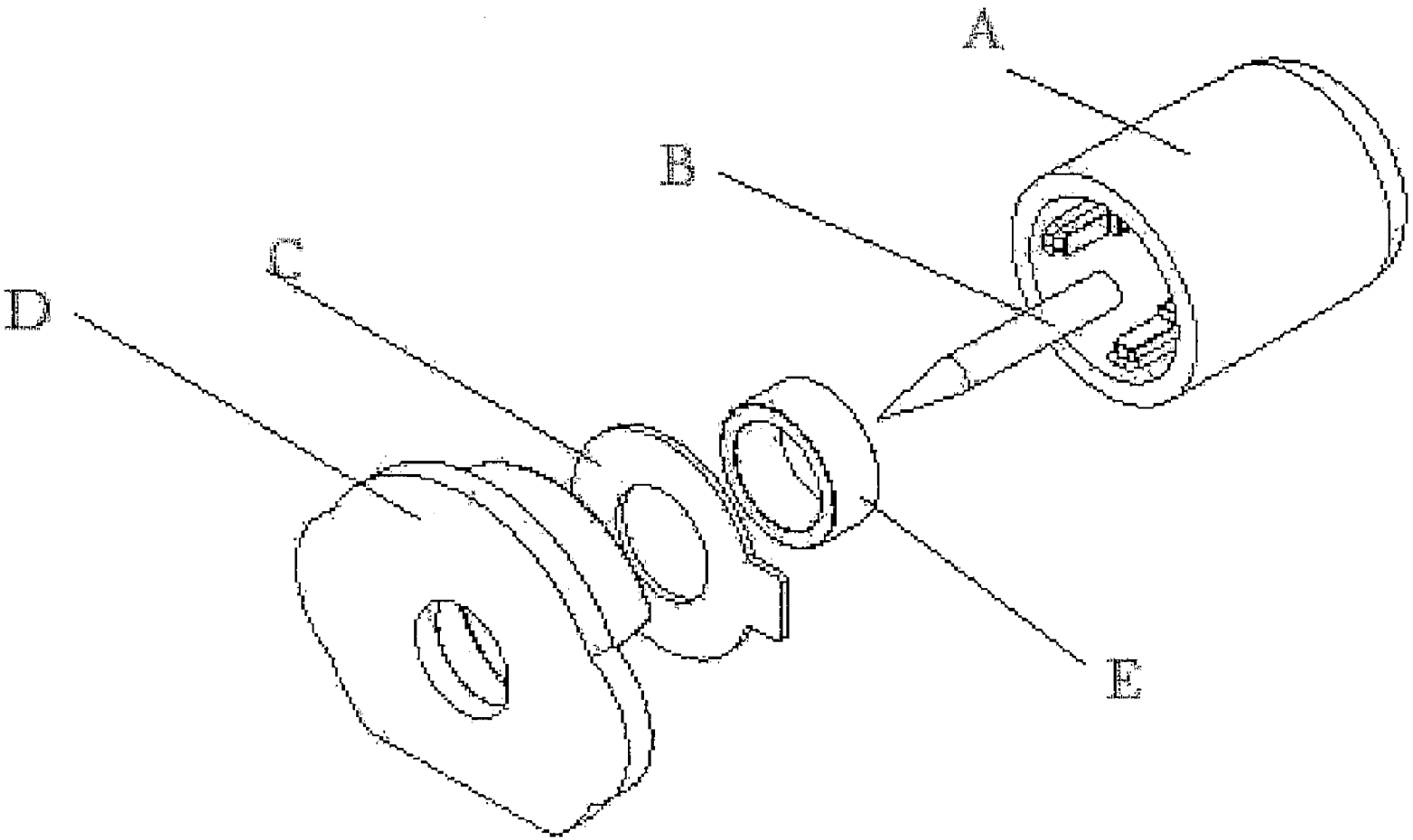
FIG. 8 is a schematic view of a triode negative ion generator.
Figure 9:
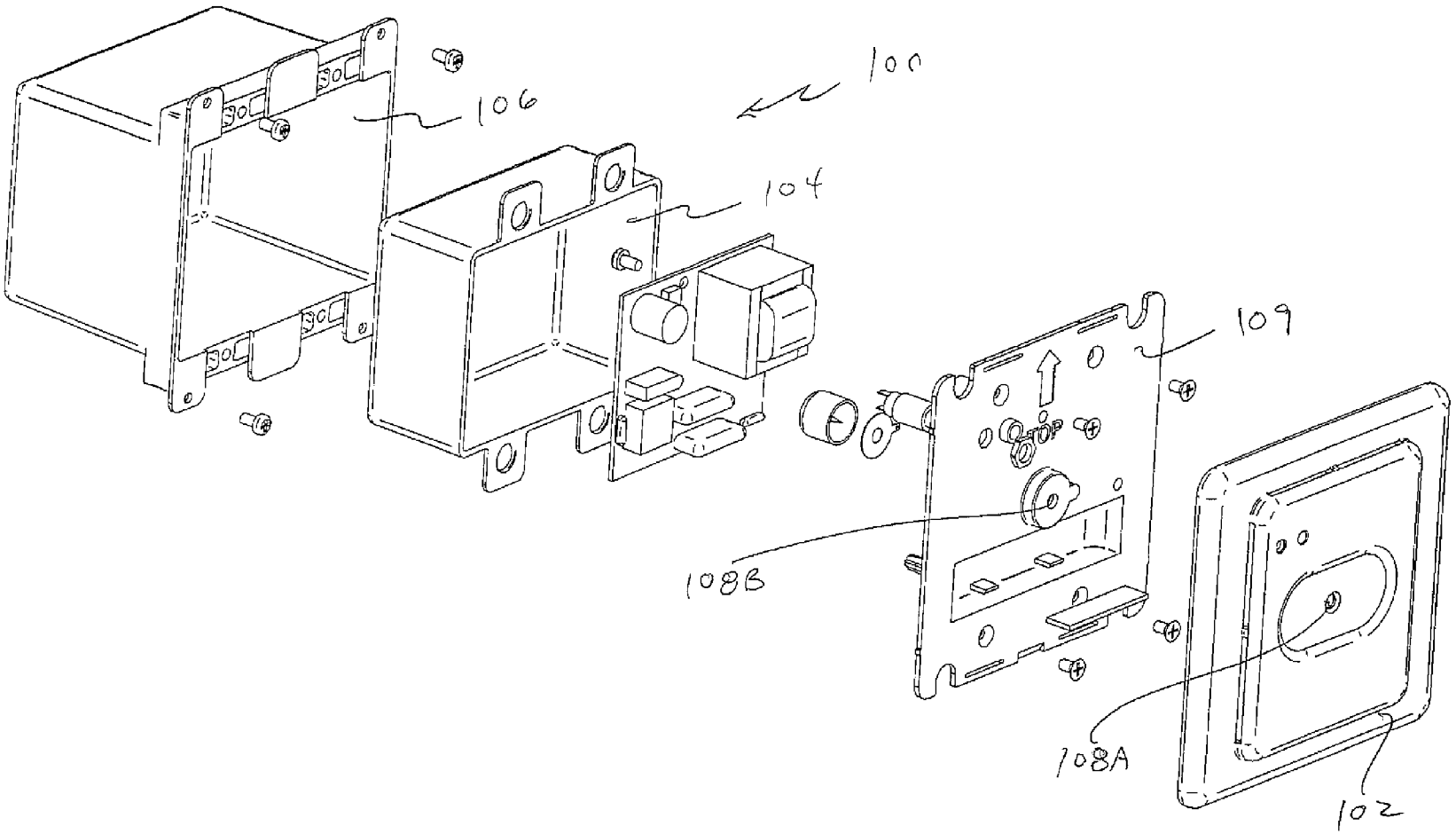
FIG. 9 is a view of a housing for use in connection with the present invention.

As illustrated in FIGS. 7 and 8, an additional metal electrode (E) at a negative potential V1, is provided for deflecting ion current through the counter electrode (C) with up to 50% efficiency wherein the counter electrode (C), held at a potential V2, is retained within an insulating cup (D) which attaches to the insulating body of the device (A), which in turn, is mounted in the support 109 of FIG. 9.

As illustrated in FIG. 9, a housing 100 for a preferred embodiment of the present invention includes a cover 102 that is mounted on a retaining unit 104 that is positioned within the lower housing 106. An opening 108A for emitting ion current is provided in the cover 102. An opening 108B for emitting ion current is provided in the plate 109.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A negative ion generator comprising:

a multi-electrode device;

a first electrode (B), which is an emitter for generating a current;

a second electrode (C) including an aperture therein, a distal end of the emitter being operatively positioned proximate to the second electrode (C);

a third electrode (E) including an aperture therein, said third electrode being spaced a predetermined distance from the second electrode (C) and being operatively positioned symmetrically around the emitter (B) for increasing the through-put of the negative ion generator by reducing a total emitted current while maintaining a fairly constant level of available negative ion current.

2. The negative ion generator according to claim 1, wherein the third electrode (E) is cylindrical in shape and has a thickness in an axial direction thereof that is greater than that of the second electrode (C).

3. The negative ion generator according to claim 1, wherein the second electrode (C) is a counter electrode, and the third electrode (E) is a control electrode.

4. The negative ion generator according to claim 1, wherein the third electrode (E) operates without a connection to a high voltage supply.

5. The negative ion generator according to claim 1, wherein the third electrode (E) operates with a connection to a high voltage supply.

* * * * *